United States Patent [19]

Montean

[11] Patent Number: 4,710,754

[45] Date of Patent: Dec. 1, 1987

[54] MAGNETIC MARKER HAVING SWITCHING SECTION FOR USE IN ELECTRONIC ARTICLE SURVEILLANCE SYSTEMS

[75] Inventor: Samuel Montean, Blaine, Minn.

[73] Assignee: Minnesota Mining and Manufacturing Company, St. Paul, Minn.

[21] Appl. No.: 909,340

[22] Filed: Sep. 19, 1986

[51] Int. Cl.[4] ..... G08B 13/18

[52] U.S. Cl. ..... 340/572; 340/551

[58] Field of Search ..... 340/551, 572

[56] References Cited

U.S. PATENT DOCUMENTS

| | | | |
|---|---|---|---|
| 3,665,449 | 5/1972 | Elder et al. | 340/572 |
| 3,747,086 | 7/1973 | Peterson | 340/572 |
| 3,790,945 | 2/1974 | Fearon | 340/572 |
| 4,074,249 | 2/1978 | Minasy | 340/572 |
| 4,075,618 | 2/1978 | Montean | 340/572 |
| 4,249,167 | 2/1981 | Purinton et al. | 340/572 |
| 4,300,183 | 11/1981 | Richardson | 361/152 |

FOREIGN PATENT DOCUMENTS

| | | | |
|---|---|---|---|
| 763681 | 3/1934 | France | 340/551 |

*Primary Examiner*—Glen R. Swann, III

*Attorney, Agent, or Firm*—Donald M. Sell; James A. Smith; William B. Barte

[57] ABSTRACT

A magnetic marker for use with electronic article surveillance systems in which a very high order harmonic response is obtained with postage-stamp sized pieces of high permeability material shaped to have a narrow switching section within which flux is concentrated by larger sections on each end of the switching section, the concentrated flux being sufficient to result in a high harmonic response.

28 Claims, 10 Drawing Figures

MAGNETIC MARKER HAVING SWITCHING SECTION FOR USE IN ELECTRONIC ARTICLE SURVEILLANCE SYSTEMS

FIELD OF THE INVENTION

This invention relates to electronic article surveillance (EAS) systems and markers used therein, and in particular, to such markers in which a piece of magnetic material utilized in the marker is interrogated by an alternating magnetic field and produces harmonics of the field which are detected to indicate the presence of the marker.

BACKGOUND OF THE INVENTION

It is now well known to utilize a piece of low coercive force, high permeability magnetic material as a harmonic generating EAS marker. Such markers were perhaps first disclosed in the French Pat. No. 763,681, issued in 1934 to Pierre Arthur Picard. More recently, it has become relatively well known to use particularly configured pieces, such as elongated strips of high permeability material, in order to enhance the production of very high order harmonics, thereby improving the reliability with which such markers can be distinguished over signals from other articles such as briefcase frames, umbrellas, etc. Such uses are exemplarily set forth in U.S. Pat. Nos. 3,665,449, 3,790,945 and 3,747,086. As such elongated strips are generally detectable only when the interrogating field is aligned with the strips, it is also known from such disclosures to provide for multi-directional response, by providing additional strips in an L, T or X configuration. Alternatively, in U.S. Pat. No. 4,074,249 (Minasy), it is proposed that multi-directional response may be obtained by making the strip crescent-shaped. Furthermore, it is known from U.S. Pat. No. 4,249,167 (Purington et al.) to make a deactivatable multi-directionally responsive marker by providing two elongated strips of permalloy arranged in an X configuration with a few hard magnetic pieces adjacent and co-linear to each of the permalloy strips. (See Col. 14,lines 58–62).

While still recognizing that an elongated, or "open-strip" configuration is desired in order to obtain a very high order harmonic response, U.S. Pat. No. 4,075,618 (Montean) discloses that a marker capable of generating very high order harmonics, thereby being operative in a system such as described in the '449 patent, could be made by adding flux collectors to a short strip of high permeability material which is insufficiently long to meet the definition of an "open-strip". Picard also suggests that polar extensions may be provided to increase the sensitivity, while Fearon '945 suggests the use of pole piece coupons to collect flux.

Markers such as disclosed by Elder, Fearon, Peterson, Minasy and Montean in the above patents have all enjoyed certain commercial success. However, the use of the markers has been restricted by the size, and still primarily elongated shape heretofore believed to be necessary.

EAS systems in which the markers of the present invention are particularly useful typically produce within the interrogation zone fields in a variety of directions. For example, as disclosed in U.S. Pat. No. 4,300,183 (Richardson), such differently directed fields may be produced by providing currents in coils on opposite sides of the interrogation zone which are alternately in-phase and out-of-phase. The resulting aiding and opposing fields at any given location may be appreciably weaker in one direction than another. Accordingly, a given marker may be unacceptable if reliably detectable only when oriented in the direction associated with the strongest fields produced by the EAS system. Preferably, a commercially viable marker would have a sensitivity so as to be reliably detectable regardless of how it is oriented in the zone, however, in a practical sense, it is not necessary to detect markers in each and every orientation and/or location in the zone.

Typically, such EAS systems are originally designed to be used with elongated "open strip" type markers, are the Model WH-1000 and 1200 systems, marketed by Minnesota Mining and Manufacturing Company. For example, such systems typically produce within the interrogation zones magnetic fields alternating at 10 kHz, and having minimum intensities at the center of the zone of approximately 1.2 oersteds (Oe) when the fields generated in coils on opposite sides of the zone are in an opposing configuration and of approximately 2.4 Oe when in an aiding configuration. The receiver portions of such systems process signals from receiver coils positioned within panels adjacent to the interrogation zone, and activate an alarm circuit in the event signals corresponding to very high order harmonics of the applied field are detected.

To compare the performance of various markers, it is convenient to use a test apparatus which generates fields alternating at a predetermined frequency and has controllable strength comparable to those encountered in such EAS systems. The test apparatus should detect signals in accordance with the harmonic characteristics relied upon in such systems and provide sensitivity values, based on a standard marker to ensure valid comparative results.

Such a test apparatus is preferably calibrated against a present commercially available marker such a type WH 0117 Whispertape brand detection strip manufactured by Minnesota Mining and Manufacturing Company, which is formed of an amorphous metal 6.7 cm long, 1.6 mm wide and 0.02 mm thick and having the following nominal composition (at %): Co: 69%; Fe: 4.1%; Ni: 3.4%; Mo: 1.5%; Si: 10%; and B: 12%. Such a marker is inserted parallel with the field of the test apparatus and the gain is adjusted to indicate a standardized sensitivity value of 1.0 at a 10 KHz field of 1.2 oersteds, that being the minimum field strength at which such a marker would be expected to be reliably detected. At a higher field of 2.4 oersteds, a sensitivity of 4.8 was observed when the amorphous marker was similarly aligned.

It has long been desired to minimize the length of such elongated markers. However, short strips do not have sufficient sensitivity to be even marginally acceptable even at a high field strength and even when dimensioned to maximize high order harmonic response. For example, a 0.02 mm thick ribbon of the amorphous metal described above was cut to provide 2.5 cm long strips 1.6 mm, 0.8 mm and 0.5 mm wide. Relative sensitivities shown in the following table were then determined using the same procedure described above.

| | Strip Width (mm) | | |
|---|---|---|---|
| Field Strength (Oe) | 1.6 | 0.80 | 0.5 |
| 1.2 | 0.014 | 0.034 | 0.037 |
| 2.4 | 0.18 | 0.18 | 0.017 |

-continued

| Field Strength (Oe) | Strip Width (mm) 1.6 | 0.80 | 0.5 |
|---|---|---|---|
| 3.0 | 0.28 | 0.25 | 0.025 |

It may thus be recognized that regardless of whether the strips were made very narrow, thus minimizing the demagnetization effects, or were made wider, thus providing a greater total mass, in all cases an unacceptable sensitivity level resulted. When a 2.5 cm long piece was further dimensioned with polar extensions proportional to that depicted in FIG. 7 of Picard, in which the length of the center section is about eight times the center width and the overall length about 13 times the center width, standardized sensitivity values of 0.02, 0.26 and 0.46 were observed at the three field strength noted above, thus showing that while increases in sensitivity do result by adding polar extensions as taught by the prior art, such benefits are still not sufficient to result in even a marginally acceptable marker.

SUMMARY OF THE INVENTION

In contrast to the above described markers, it has now been determined that very high order harmonics may be generated by markers which are made of magnetic materials similar to those used in the past, but which are much smaller than heretofore known and are not formed of elongated strips. Rather, it has been found that very high order harmonics are readily generated in a high permeability material having a square or rectangular, i.e., postage-stamp, shape, which has at least one very short, narrow cross-sectional center section formed of a high permeability, low coercive force material and which has flux collectors proximate to each end of the center section. The center section thus functions as a magnetic switching section to generate the very high order harmonic response so long as the flux collectors are sufficiently wide to collect and concentrate a significant amount of flux within the switching section. By so concentrating the magnetic flux in the switching section the effective flux density is increased so that the magnetization in that section is very rapidly reversed upon each reversal of the applied field and very high order harmonics are generated at a given applied field intensity just as though an elongated strip were present. It has been found that the signals produced by such markers, while containing very high order harmonics upon which detection can be reliably based, also contain various other isolatable characteristics making the markers useful in other systems in which harmonics per se may not be isolated.

The switching sections and flux collectors making up the magnetic construction have overall dimensions in which the length and width are not greater than 3.2 cm, and are preferably less than 2.5 cm. The switching section is formed of a piece of low coercive force, high permeability material having a minimum width at which the cross-sectional area is in the range of 0.003–0.03 $mm^2$. The length of the switching section normal to its minimum width is not greater than 20 times that width and is less than 2.0 cm, the terminal ends of each switching section being further defined by points at which the width (parallel to the minimum width) is no longer less than five times the minimum width.

Each of the flux collectors is formed of co-planar sections of a sheet-like material of low coercive force, high permeability material having a maximum width parallel to the width of the switching section which is at least ten times the minimum width of the switching section.

Such a marker is still basically responsive in only one direction, and may be only marginally acceptable, as relative sensitivities of only about 0.4 result when measured at the weakest field of 1.2 oersteds. However, values in excess of 1.0 are observed at higher intensities, such that the marker would be detected under all but the least favorable conditions.

In a preferred embodiment enabling detection in at least two substantially different directions, the marker of the present invention comprises at least two switching sections such as described above, the lengths of which extend in substantially different directions. Furthermore each switching section preferably shares at least one common flux collector. Such an embodiment is particulary desirably constructed of a substantially square, sheet-like piece of low coercive force, high permeability material having a portion removed from the interior thereof to result in at least two narrow regions between the removed portion and two adjacent outer edges of the piece, which narrow regions define two switching sections extending normal to each other. Preferably, the removed portion is circular and is centered within the square piece to result in four switching sections proximate the mid point of each side of the piece, with the four corner portions providing flux collectors for two pairs of switching sections, each pair being at right angles to each other. Such a marker will then be detectable regardless of its orientation, as when one side of the marker is oriented in the direction of a weak field, so as to produce only a marginally acceptable signal, another side may be oriented parallel to a stronger field and will thereupon result in an adequately detectable signal.

A marker such as described in the above embodiments is conveniently made dual-status, i.e., reversibly deactivatable and reactivatable by including a piece of remanently magnetizable material adjacent each of the switching sections, which piece when magnetized provides fields which bias the magnetization of the switching section to alter the response of the marker resulting from the alternating magnetic field encountered in the interrogation zones.

DETAILED DESCRIPTION

Figure 1:
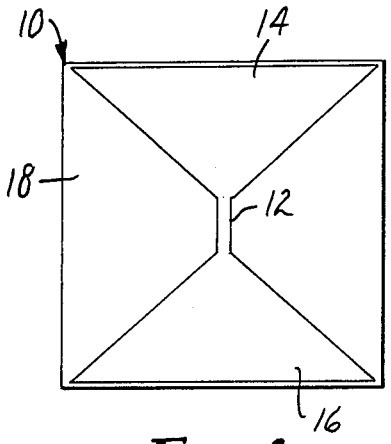
FIG. 1 is a plan view of one embodiment of the marker of the present invention having triangular shaped flux collectors.

As shown in the plan view of FIG. 1, one embodiment of the marker of the present invention comprises a sheet of low coercive force, high permeability material, such as permalloy. The sheet is cut to have at least one center or switching section of reduced cross-sectional area and a flux collector adjacent each opposite end of the switching section. Thus, in FIG. 1, the marker 10 has a switching section 12 and triangular shaped flux collectors 14 and 16. The marker is preferably cut from a sheet of permalloy, 0.015 mm thick, such that the overall width and length of the piece is 2.5×2.5 cm respectively. The switching section 12 is symmetrically centered between the flux collectors 14 and 16, and has a width of 0.76 mm and a length of 4.8 mm. The thus cut sheet is desirably adhered via a pressure sensitive adhesive to a backing layer 18 such as paper, stiff plastic sheeting, etc.

When a marker according to the present invention as described above in relation to FIG. 1 is positioned with the length of the switching section aligned with the field in the test apparatus described above, the flux collector thereby being oriented to concentrate flux within the switching section, a relative sensitivity value of 0.4 was observed at the minimum field intensity of 1.2 oersteds, the value increasing to 1.0 at a field intensity of 2.4 oersteds, and 1.3 at 3.0 oersteds. An identically shaped marker prepared from 0.02 mm amorphous material described above exhibited sensitivities of 0.25, 1.1 and 1.4 when tested at the same field intensities.

Markers according to the present invention are also useful in systems operating over a range of frequencies. While in the tests noted above, a frequency of 10 kHz was used, as that frequency corresponds to the frequency used in the 3M Model WH-1000 and 1200 systems, equivalent performance has been observed when the markers are tested at other frequencies.

As noted above, the cross-sectional area of the switching section of the marker of the present invention is very important to the resultant sensitivity. For example, a series of tests were conducted with markers constructed from 0.015 mm thick permalloy in which the overall dimensions of the flux collectors and the length of the switching sections were the same as that described above with reference to FIG. 1, and in which the width of the switching section was variously 0.13, 0.38, 0.76 and 1.4 mm, respectively (i.e., the cross-sectional area of the switching section thus being variously 0.0020, 0.0058, 0.012 and 0.021 $mm^2$, respectively). In this series, relative sensitivities at the minimum field intensity of 1.2 Oe were 0.14, 0.26, 0.4 and 0.22 respectively, while at 2.4 Oe were 0.26, 0.44, 1.1 and 0.84, respectively. It will thus be recognized that a greater increase in sensitivity occurred as the markers having the wider switching sections were exposed to more intense fields, presumably because the greater amount of flux available was able to saturate more material and thereby create a more intense signal. However, when the cross-sectional area of the switching section becomes too large, the available flux was insufficient to saturate all of the material in the section, and the sensitivity decreased.

Some of the results summarized above were made with markers of the various shapes cut from sheets of permalloy. The magnetic properties of such a material are known to be quite sensitive to mechanical working, and the damage to the edges of the sheets as portions were cut away to form the switching sections drastically affects the resultant sensitivity, particularly when the dimensions of the remaining portions are sufficiently small that the damage extends throughout most of the remaining portion. Markers prepared so as to avoid edge damage effects, such as by etching away the unwanted portions, post-annealing, or by using materials less strain sensitive, such as high permeability amorphous alloys, exhibit appreciably greater sensitivities for a given size, that advantage being offset to various degrees by competing factors of greater intrinsic material costs or greater manufacturing expenses.

Figure 2A:
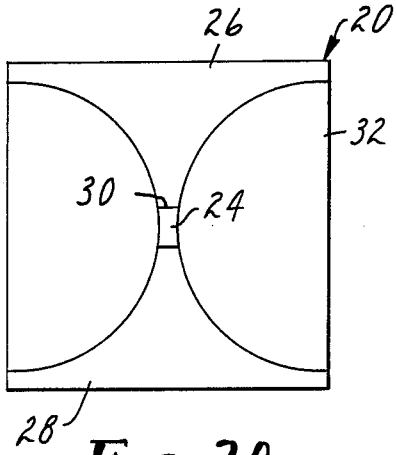
FIGS. 2A and 2B are plan views of another embodiment in which the switching section and adjoining flux collectors are defined by opposing circular removed portions.
Figure 2B:
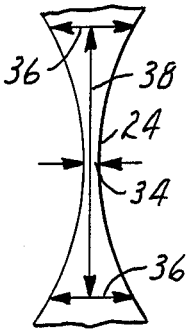

Another embodiment of the marker similar to that discussed above with respect to FIG. 1, is shown in the top view of FIG. 2A. The marker 20 shown in that Figure, is similarly preferably constructed from a sheet of permalloy, fabricated to have a center switching section 24 and flux collectors 26 and 28 at each end, adhered to a backing sheet 32. In this embodiment, the switching section 24 was formed by punching semicircular areas out of the sheet such that the switching section 24 is formed in the center region between the semicircular cut-outs. Unlike the embodiment of FIG. 1 wherein the switching section is readily defined, in the embodiment of FIG. 2A, there is a gradual transition between the switching section 24 and the adjacent flux collectors 26 and 28. Particularly, in such an instance, it is convenient to define the limits of the switching section 24 as shown in the enlarged view of FIG. 2B as having a minimum width ($W_{min}$) 34 and a length (L) 38 normal to the minimum width which is not greater than twenty times the minimum width. The terminal ends of the length L are at lines 36 at which the width is no longer less than five times the minimum width. In a preferred embodiment in which the overall dimensions of the marker 20 are 2.5 cm wide ×2.5 cm long, the switching sections are conveniently produced by stamping semicircular notches from opposite sides, leaving a 0.76 mm wide switching section therebetween. When tested in the manner described above, at the minimum field strength of 1.2 Oe, such a marker typically exhibits a sensitivity of about 0.3 to 0.4, depending upon the extent to which signal degradation due to edge damage effects was avoided.

Also shown as a part of the marker 20 of FIG. 2A is a second element 30 of a higher coercive force, remanently magnetizable material such as vicalloy, carbon steel, or the like, the addition of such a piece making the marker dual-status. Such a material, when magnetized in the region of the switching section, provides an external magnetic field which biases the adjacent switching section to either keep the magnetization therein from reversing when in an alternating interrogation field, or of at least altering the response then produced. In either case, readily distinguishably different signals are produced, depending upon whether the second element 30 is magnetized or demagnetized.

As noted above, the markers 10 and 20 shown in FIGS. 1, 2A and 2B desirably include non-magnetic backing layers 18 and 32 respectively. Such layers may be pieces of stiff paper, cardboard, plastic sheet, etc., and may be on either or both sides of the magnetic sheet as desired. The layers thus protect the magnetic sheets from deformation, bending, flexing and the like, which could adversely affect the magnetic response, conceals the magnetic material and provides printable surfaces on which user information may be added, etc. Similarly, pressure sensitive adhesive layers, low adhesion carrier liners, printable top layers, and the like may also be included.

The markers discussed above with respect to FIGS. 1, 2A and 2B exhibit maximum sensitivity in one direction only, i.e., the markers must be oriented with respect to fields present in the interrogation zone such that the flux collectors subtend as many lines of flux as possible. To ensure that such markers are detected regardless of orientation, it is thus desirable to provide in the zone fields in three orthogonal directions. Such constraints on the field producing portion of the system clearly add complexity and cost to the systems.

Figure 3:
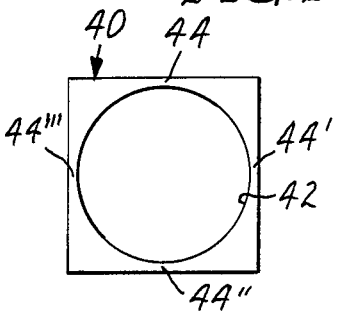
FIGS. 3–5 are plan views of triangular and square shaped markers of the present invention.

In another embodiment of the present invention, markers are provided which exhibit sensitivity in at least two directions, thereby allowing the field producing apparatus to be simplified such that fields need only be present in two orthogonal directions. One such multi-directionally responsive marker 40 is shown in FIG. 3 to comprise a square sheet of high permeability material such as permalloy or the like, in which a circular center portion 42 has been removed, having four switching sections 44, 44', 44" and 44'" at the mid point of each straight side. The corners of the square thus form flux collectors for the switching sections, each corner acting as a flux collector for two switching sections extending therefrom. Such a marker, formed of 0.015 mm thick permalloy 2.5 cm long on each side, and having a circle removed from the center, thereby forming 0.76 mm wide switching sections, was found to have an equivalent sensitivity of 0.34 when measured as described above at the minimum field intensity, and positioned such that any one of the straight sides was aligned with the field in the solenoid. At field intensities of 2.4 Oe and 3.6 Oe respectively, sensitivities of 1.1 and 1.6 were observed.

Figure 4:
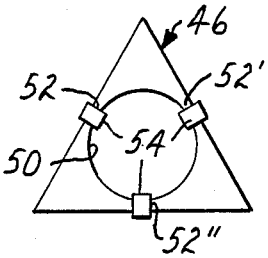

Multi-directional markers may analogously be provided from a variety of other two dimensional shapes, particularly of regular polygons, thus minimizing material waste. Another such multi-directionally responsive marker 46 is shown in FIG. 4 to be formed of a triangle of high permeability material such as described above, again in which there is removed a circular center portion 50, leaving narrow switching sections 52, 52',and 52" at the mid point of each side. In the embodiment shown in FIG. 4, the marker has further been made to be dual status by including sections 54 of remanently magnetizable material overlying each switching section. As described above in conjunction with the embodiment shown in FIG. 2, magnetization of the sections 54 result in localized fields which bias the high permeability material in the adjacent switching sections 52, 52', and 52", and alters the signal resulting when the marker is exposed to alternating fields in an interrogation zone. A marker with the shape of an equilateral triangle constructed from 0.015 mm thick permalloy 2.5 cm on each side and having a circle removed from the center, leaving 0.58 mm wide switching sections along each side was found to exhibit marginally acceptable sensitivity when any of the sides were aligned with a minimum 1.2 Oe field in the test appartus described above.

As particularly noted above in conjunction with FIG. 1, the cross-sectional area of the switching section has been found to be of particular importance in determining the sensitivity of the resultant marker. A square marker such as shown in FIG. 3 may be conveniently formed from a large sheet of permalloy, which is then cut and/or stamped to remove the circular center areas and to separate the individual square pieces. As the switching sections are typically in the range of 0.76 mm wide, the circular areas to be removed from adjacent sections are thus 1.52 mm apart. Accordingly, the location of the cut between the removed circular portions must be very accurately controlled to ensure that the width of each switching section is 0.76 mm, and not, for example, 0.64 mm on one side and 0.89 mm on the other side of the cut. While such variability would result in usable markers, the variation in sensitivities from marker to marker precludes optimization of the marker with a given system.

Figure 5:
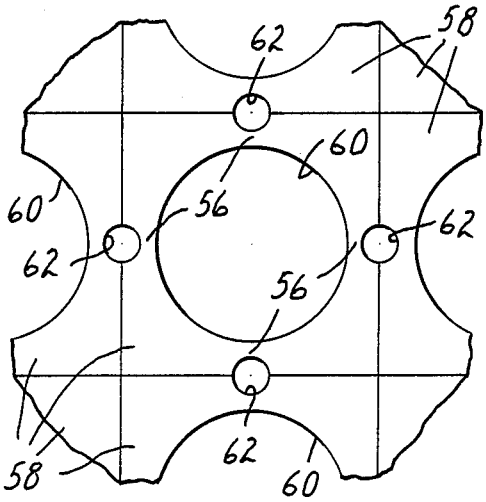

It has thus been found preferable to establish the dimensions of the switching sections independently of the precise location of the cut lines between adjacent markers and holders. As shown in FIG. 5 herein, it is thus preferred to define the width of each switching section 56 along each edge of the markers 58 as the width of the material remaining between a large punched-out center hole 60 and smaller notches located approximately halfway along the edge. Accordingly, as in FIG. 5, a sheet of permalloy is desirably provided with a pattern of alternating large and small holes 60 and 62 which extends both along and across the web. The size and location of the punched holes 60 and 62 are determined by a punch and die operation or by etching. The 0.030 inch wide switching sections 56 are thus precisely defined independently of the precise location of the cut line between the markers, and the markers may be subsequently separated from each other by cutting along lines extending through the small holes, resulting in the notches along each side, both across and down the web. In this manner, the markers may be manufactured in large quantities by roller dies and the like without need for precise alignment and positioning of the cutting shears or dies.

Figure 6:
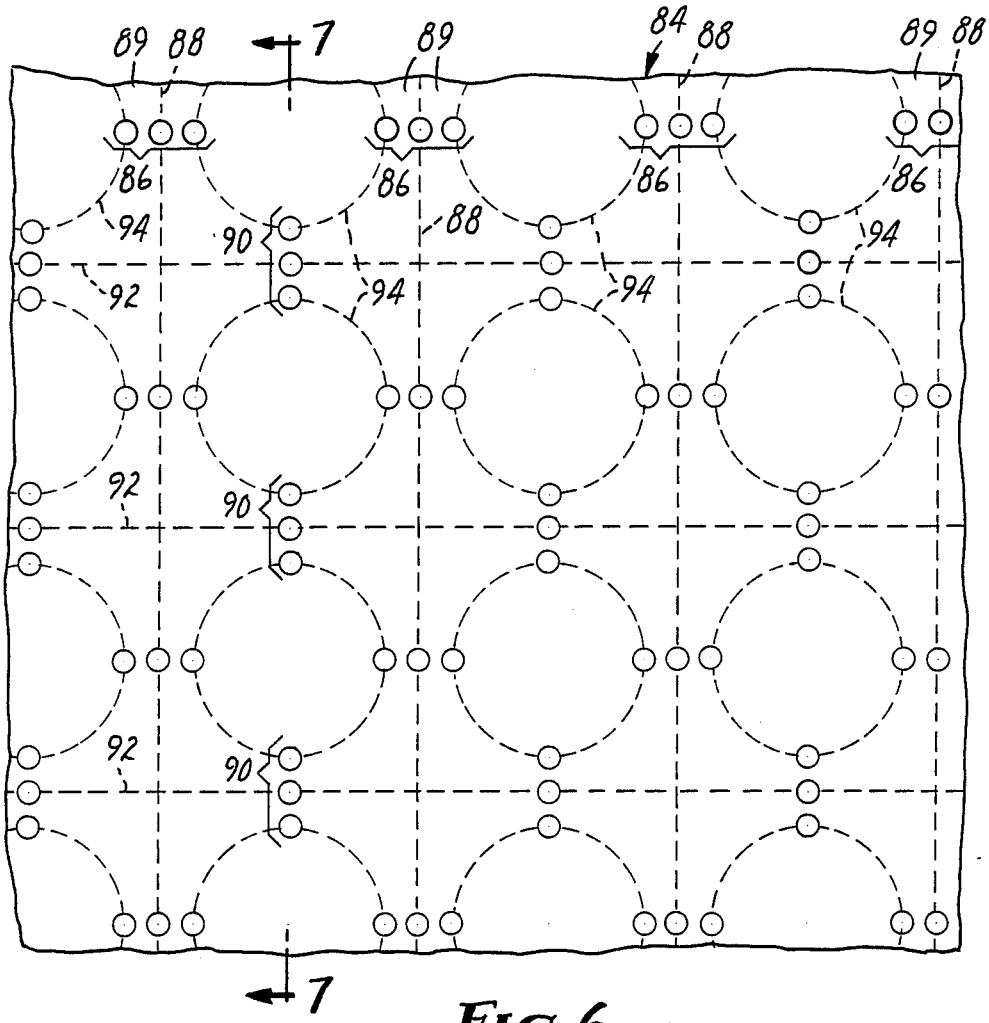
FIG. 6 is a plan view of a punched sheet containing a plurality of markers.

Such mass-produced, multi-directionally responsive markers are desirably made by a series of punching or etching, slitting, and laminating operations. Thus, for example, as shown in FIG. 6, a web 84 of high permeability material, such as a 0.015 mm thick sheet of permalloy is provided which is sufficiently wide to allow a plurality of markers positioned side by side to be cut therefrom, the number of markers thus formed in the down-web direction being only limited by the length of the web. Typically, a web six inches wide may be utilized, thus allowing six markers to be formed side-by-side. In a particularly preferred embodiment, the sheet is then punched with a first set of repetitive patterns 86, each pattern consisting of three adjacent holes extending normal to lines 88 extending parallel to the length of the web along which the sheet will be subsequently cut to form strips 89 of a series of individual markers. Similarly, the sheet is also punched with a second set of repetitive patterns 90 of three adjacent holes extending normal to lines 92 extending cross-web along which the strips 89 will be cut to separate the individual markers. In the embodiment shown in FIG. 6, when square markers approximately 2.54 cm on each side are desired, the lines 88 and 92 will thus be 2.54 cm apart, and each of three holes making up the patterns 86 and 90 will be 3.2 mm diameter, with a 0.76 mm space between adjacent holes.

The web 84 is subsequently passed through a punch and die to remove larger circular areas 94, the areas being approximately centered within the inner facing four holes of each of the markers being formed. As the widths of the respective switching sections are defined by the spacing between the adjacent holes within the sets of three holes, it will be evident that the precise location of the larger, centrally located holes is much less critical.

If the web consists of a strain-sensitive material such as permalloy, it is desirable that the web be annealed to maximize the magnetic response. While such annealing can be done prior to any of the punching operations, it is preferable to anneal after the two sets of holes are formed, thereby eliminating damage done during the punching operation. While a certain amount of damage may also result during subsequent slitting, it has been found that such damage is not as significant, particularly if care is given to the slitting operation, and acceptable markers are formed even though no annealing is done after slitting. A further improvement may be affected by angling each set of three holes 86 and 90 with respect to the cut lines 88 and 92 such that the width of the switching sections is at an angle such as 45° with respect to the cut lines. Accordingly, such mechanical working and stress induced signal degradation as may occur as the strips 89 are wound in a roll and dispensed will be minimized.

Figure 7:
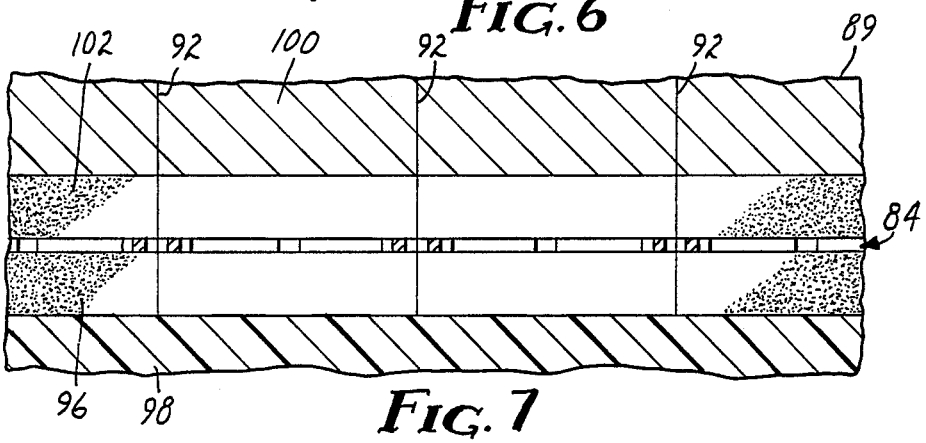
FIG. 7 is a side view taken along the line 7—7 FIG. 6.

As shown in the cross-sectional view of FIG. 7, taken across the line 7—7 in FIG. 6, and wherein the vertical dimensions are greatly enlarged for clarity, one side of the thus punched and annealed permalloy web 84 is next preferably laminated to a 0.05 mm thick pressure sensitive adhesive layer 96, the opposite side of which is covered by a 0.13 mm thick low adhesion release liner 98, which may be subsequently removed, allowing the markers to be affixed to articles via the adhesive layer 96. The other side of the punched metal web 84 is laminated to a 0.10 mm thick printable cover layer 100 via a 0.05 mm thick pressure sensitive layer 102. This laminate is then severed along the lines 88, thus forming the strips 89 along the length of the web, and is partially slit along the line 92, leaving unsevered the release liner 98, to thereby support the strip. The strips may then be wound into rolls for subsequent use in label guns and the like, wherein individual markers are peeled away from the release liner just prior to being adhered to articles to be protected.

Figure 8:
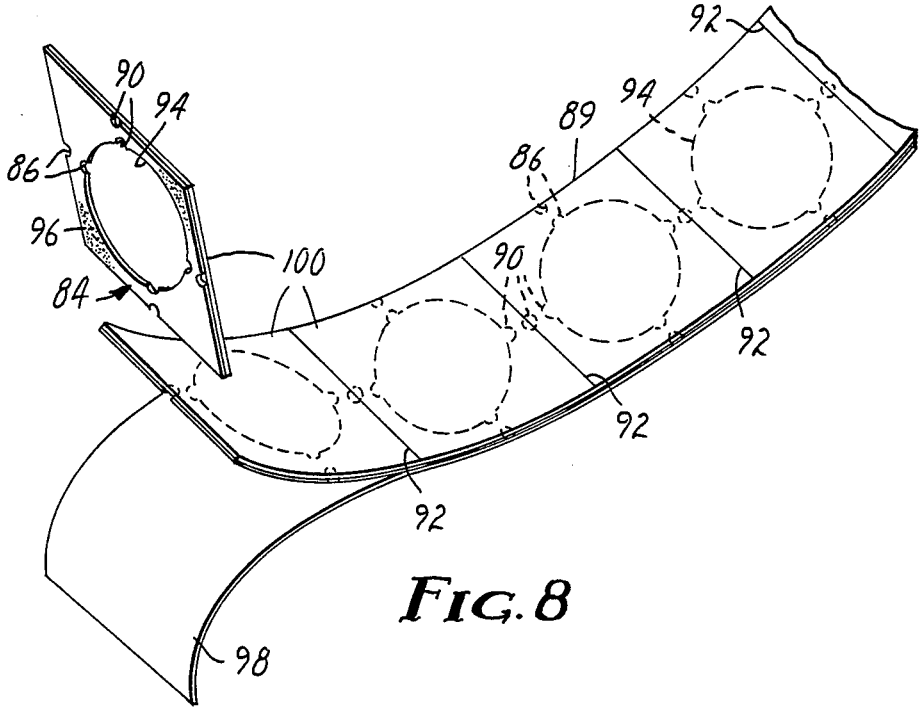
FIG. 8 is a perspective view of a strip of markers formed from the sheet shown in FIG. 6.

Further details of one strip 89 after the final laminate is formed are shown in FIG. 8. In that figure, it may be seen that the top surface of the punched metal strip 89 is laminated to the printable surface layer 100 via the pressure sensitive adhesive layer 102. Also, the bottom of the strip 89 has adjacent thereto the layer of pressure sensitive adhesive 96, which in turn is covered by the low adhesion carrier layer 98. All of the layers except for the carrier layer 98 are cut along the lines 92, thus allowing the strip to be dispersed in roll form, and individual markers peeled away from the carrier layer 98 as the strip is unwound.

Figure 9:
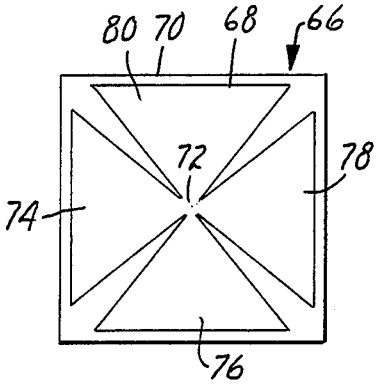
FIG. 9 is a plan view of a two dimensionally responsive counterpart of the embodiment of FIG. 1.

In the multi-directionally responsive markers described above, flux collectors have been formed which have in common therewith more than one switching section. Another embodiment of a multi-directionally responsive marker of the present invention comprises a switching section having more than two flux collectors associated therewith. Thus, as shown in FIG. 9, such a marker 66 may comprise a sheet 68 of high permeability material laminated to a non-magnetic backing sheet 70. The high permeability sheet 68 is cut into an "iron-cross" configuration, such that there is a switching section 72 at the center, and four flux collectors 74, 76, 78 and 80 magnetically coupled to the switching section. One pair of flux collectors 74 and 78 thus collects flux along a first direction, while the other pair of collectors 76 and 80 collects flux at 90° from the first direction, thus providing the desired multi-directional response. The marker shown in FIG. 9 may further be made dual status by including a piece of remanently magnetizable material overlying the switching section, which when magnetized, alters the response produced by the high permeability section.

To further demonstrate the versatility of markers of the present invention in systems operating at various frequencies, markers such as described above in conjunction with FIGS. 6–8 were tested in the test apparatus described above, but wherein the solenoid was energized at 10,000 Hz, 1000 Hz and 100 Hz, and the receiver circuits were adjusted to process the same, very high order harmonics. Measurements were made at a field intensity of 1, 2 and 3 oersteds. In each case the sensitivity was compared to that of an amorphous strip, 6.67 cm long, 1.6 mm wide and 0.020 mm thick. The following relative sensitivities were measured:

| | Frequency | | | | | |
|---|---|---|---|---|---|---|
| | 10,000 Hz | | 1000 Hz | | 100 Hz | |
| Field Intensity | 2.5 cm × 2.5 cm marker | 6.7 cm strip | 2.5 cm × 2.5 cm marker | 6.7 cm strip | 2.5 cm × 2.5 cm marker | 6.7 cm strip |
| 1 Oe | 0.18 | 0.6 | 0.027 | 0.12 | 0.006 | 0.025 |
| 2 Oe | 0.65 | 3.6 | 0.10 | 0.70 | 0.011 | 0.075 |
| 3 Oe | 1.28 | 6.6 | 0.17 | 1.1 | 0.02 | 0.12 |

It may thus be further appreciated that the sensitivity of the square marker of the present invention at a field intensity of about two oersteds is about the same as that observed from the amorphous strip when measured at a field intensity of one oersted. While the sensitivity of the square marker in any given direction is thus less than that of an elongated strip, the square marker responds to fields in at least two directions, and is thus desirably used in systems in which fields in fewer directions are present, or in which fields in one or more directions are stronger than that produced in other directions. It will also be appreciated that at lower frequencies the relative detected signal strengths were observed to significantly decrease, thus demonstrating the desirability of operating at higher frequencies. Alternatively, the receiver/detection circuits are desirably made more sensitive.

While the marker of the present invention has been described above as being formed from a single sheet of high permeability material numerous comparable constructions are within the scope of the present invention. Thus, for example, the switching sections may be formed of separate pieces of high permeability material which are connected to separate flux collection pieces so as to provide a low reluctance path therebetween. The switching sections may be of any cross-sectional shape, and may thus be formed from sheet stock, wires, etc.

Likewise, a wide variety of configurations of flux collectors are within the scope of the present invention. For example, while it is preferred to form the collectors and switching sections by removing circular portions from square sheets, the overall configuration and the removed portion may be of any shape, so long as the dimensions of the switching sections and flux collectors are within the limits defined herein.

I claim:

1. A marker adapted for use in an electronic article surveillance system said marker having a substantially sheet-like configuration and comprising a magnetic construction having at least one switching section and flux collectors proximate to each end of each switching section, wherein said construction comprises pieces of magnetic material in which the overall length and width respectively are not greater than 3.2 cm and (a) wherein each of said switching sections (i) is formed of a piece of low coercive force, high permeability material;

(ii) has a minimum width at which the cross-sectional area is in the range of 0.003–0.03 $mm^2$, and (iii) has a length normal to the minimum width not greater than twenty times that width and less than 2.0 cm, the terminal ends of said length being further defined by points at which the width parallel to said minimum width is no longer less than five times the minimum width, and (b) wherein each of said flux collectors (i) is formed of co-planar sections of sheet-like material having a low coercive force and high permeability, and (ii) has a width not less than ten times the minimum width of any switching section.

2. A marker according to claim 1, wherein said minimum width of the switching section is less than 2.5 mm.

3. A marker according to claim 1, comprising at least two of said switching sections having said flux collectors on each end thereof, the lengths of the switching sections extending in substantially different directions from each other and having at least one common flux collector.

4. A marker according to claim 1, comprising a substantially square piece of low coercive force, high permeability material having a portion removed from the interior thereof, the narrowest regions between two adjacent outer edges of the piece and the outer edges of the removed portion defining two switching sections extending normal to each other.

5. A marker according to claim 4, wherein said substantially square piece exhibits substantially no damage on the edges defining the switching sections, and the absence of mechanical working along those edges allows a signal with a higher harmonic content to be produced than would otherwise occur.

6. A marker according to claim 4, wherein said removed portion is circular and is centered within said square piece to result in four of said switching sections proximate the mid point of each side of the piece, with each of the four corner portions of the piece becoming flux collectors for two switching sections at right angles to each other.

7. A marker according to claim 1, further comprising at least one piece of remanently magnetizable material positioned proximate to each switching section, and which when magnetized provides a localized field which biases the magnetization of the switching section to alter the response of the marker resulting from said magnetic field.

8. A marker according to claim 7, comprising a plurality of said switching sections, each of which has at least one flux collector in common with another switching section, and wherein at least one piece of remanently magnetizable material is positioned proximate to each switching section and which when magnetized provides a localized field which biases the magnetization of the proximate switching sections to alter the response of the marker resulting from said magnetic field.

9. A marker according to claim 1, wherein all of said switching sections and flux collectors are formed from a single sheet of low coercive force, high permeability material.

10. A compact, two directionally responsive marker adapted for use in an electronic article surveillance system, said marker comprising at least two switching sections formed of at least one piece of low coerciye force, high permeability magnetic material, each switching section having a minimum width at which the cross-sectional area is in the range of 0.003 to 0.03 $mm^2$ and a length extending normal to the width, wherein the length of each section extends in substantially different directions, and each of the switching sections has flux collectors of low coercive force, high permeability material proximate each end thereof.

11. A marker according to claim 10, wherein at least one of said flux collectors is in common with two switching sections.

12. A marker according to claim 10, wherein at least one switching section is in common with more than two flux collectors.

13. A marker according to claim 10, wherein all of said switching sections and flux collectors are formed of a single sheet of low coercive force, high permeability magnetic material.

14. A marker according to claim 10, comprising a substantially square piece of low coercive force, high permeability material not greater than 3.2 cm along each edge and having a portion removed from the interior thereof, the narrowest regions between two adjacent outer edges of the piece and the outer edges of the removed portion defining two switching sections extending normal to each other.

15. A marker according to claim 14 wherein said square piece has removed therefrom a notch proximate to the midpoint of each edge, the distance between each of said notches and said outer edges of the removed portion defining said switching sections.

16. A marker according to claim 15 wherein said square piece has removed therefrom four pairs of notches, one of the notches of each pair being formed along the edge of one side and proximate to the midpoint thereof, and the other of said pair being formed along the edge of the interior removed portion and adjacent to the other notch of said pair, such that the distances between said pairs define the minimum widths of said switching section.

17. A marker according to claim 10, wherein said removed portion is circular and is centered within said square piece to result in four of said switching sections proximate the mid point of each side of the piece, with each of the four corner portions of the piece being common flux collectors for switching sections at right angles to each other.

18. A marker according to claim 10, further comprising at least one piece of remanently magnetizable material positioned proximate to each of the switching sections and which when magnetized provides a localized field which biases the magnetization of the switching sections to alter the response of the marker resulting from said magnetic field.

19. A method of making a magnetically responsive marker adapted for use in an electronic article surveillance system, said method comprising the steps of:

(a) providing at least one switching section for said marker of at least one piece of low coercive force, high permeability material, each said switching section having a minimum width at which the cross-sectional area is in the range of 0.003 to 0.03 $mm^2$ and having a length normal to the minimum width not greater than twenty times that width and less than 2.0 cm, the terminal ends of the length being further defined by points at which the width parallel to said minimum width is no longer less than five times the minimum width, and (b) providing flux collectors proximate to each end of each switching section of co-planar sections of sheet-like material having a low coercive force and high permeability, each said flux collector having a maximum width not less than ten times the minimum width of any switching section, wherein overall magnetic construction has a length and width not greater than 3.2 cm respectively.

20. A method according to claim 19, comprising providing at least two of said switching sections having said flux collectors on each end thereof, the lengths of the switching sections extending in substantially different directions from each other and having at least one common flux collector.

21. A method according to claim 19, comprising providing a substantially square piece of low coercive force, high permeability material and removing a portion from the interior thereof, leaving narrow regions between two adjacent outer edges of the piece and the outer edges of the removed portion to define two switching sections extending normal to each other.

22. A method according to claim 21, comprising removing said interior portion by etching a narrow path through said piece, whereby the narrow remaining regions exhibit substantially no edge damage and the absence of mechanical working associated with edge damage allows a signal with a higher harmonic content to be produced than would otherwise occur.

23. A method according to claim 21, comprising removing a circular portion centered within said square piece to result in four of said switching sections proximate the mid point of each side of the piece, with each of the four corner portions of the piece being common flux collectors for switching sections at right angles to each other.

24. A method according to claim 19, further comprising the step of providing at least one piece of remanently magnetizable material and positioning said magnetizable piece proximate to said switching section, whereby when the magnetizable piece is magnetized, a localized field is produced which biases the magnetization of the switching section to alter the response of the marker resulting from said magnetic field.

25. A method according to claim 24, comprising providing a plurality of said switching sections each of which has at least one flux collector in common with another switching section, and positioning at least one piece of remanently magnetizable material proximate to each switching section, which piece when magnetized provides a localized magnetic field which biases the magnetization of the proximate switching section to alter the response of the marker resulting from said magnetic field.

26. A method according to claim 19, further comprising providing a web of low coercive force, high permeability material, punching said web to provide sets of a plurality of spaced apart holes extending normal to lines along which said web will be subsequently severed to form individual markers and in which the distance between adjacent holes of each set defines said minimum width of said switching sections and cutting through along a line extending through one of said holes of each set to separate said markers.

27. A method according to claim 26, further comprising providing a said web of polycrystalline ferromagnetic material, heat treating said polycrystalline web after punching said holes to alleviate magnetic effects due to mechanical working during said punching and cutting through said web to separate said markers after heat treating.

28. A method according to claim 27, further comprising laminating said punched web to a non-magnetic carrier layer and cutting completely through said laminate to form strips and partially through said laminate to sever all of said laminate except said carrier layer, thereby allowing individual markers to be dispensed from said strips.

* * * * *